US010156111B2

(12) United States Patent
Clemens et al.

(10) Patent No.: US 10,156,111 B2
(45) Date of Patent: Dec. 18, 2018

(54) DOWNHOLE WIRE RETRIEVAL DEVICE FOR METALLIC AND NON-METALLIC WIRE

(71) Applicant: HALLIBURTON ENERGY SERVICES, INC., Houston, TX (US)

(72) Inventors: Jack Gammill Clemens, Fairview, TX (US); David Larimore, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 217 days.

(21) Appl. No.: 15/031,155

(22) PCT Filed: Jul. 9, 2015

(86) PCT No.: PCT/US2015/039784
§ 371 (c)(1),
(2) Date: Apr. 21, 2016

(87) PCT Pub. No.: WO2017/007490
PCT Pub. Date: Jan. 12, 2017

(65) Prior Publication Data
US 2017/0175473 A1 Jun. 22, 2017

(51) Int. Cl.
*E21B 29/04* (2006.01)

(52) U.S. Cl.
CPC ..... *E21B 29/04* (2013.01)

(58) Field of Classification Search
CPC ..... E21B 29/04; E21B 31/00–31/20
See application file for complete search history.

(56) References Cited

U.S. PATENT DOCUMENTS

| | | | | |
|---|---|---|---|---|
| 1,776,026 | A | 9/1930 | Hinderliter | |
| 4,306,622 | A | 12/1981 | Armstrong | |
| 4,886,115 | A * | 12/1989 | Leggett | E21B 29/04 166/217 |
| 5,720,348 | A | 2/1998 | Hisaw | |
| 6,763,753 | B1 | 7/2004 | Brumley et al. | |
| 7,810,553 | B2 | 10/2010 | Cruickshank et al. | |
| 7,963,319 | B2 | 6/2011 | Daigle et al. | |
| 8,899,330 | B2 | 12/2014 | Misselbrook | |
| 2002/0152856 | A1 | 10/2002 | Brumley et al. | |
| 2004/0118590 | A1 * | 6/2004 | Head | B29C 47/0016 174/105 R |
| 2008/0296027 | A1 | 12/2008 | Cruickshank et al. | |

(Continued)

OTHER PUBLICATIONS

Jack Clemens, "New Slickline Smart=Release Tool Mitigates Wire-Recovery Issues in Extreme Well Conditions" (2009) SPE 124966.*

(Continued)

*Primary Examiner* — William D Hutton, Jr.
*Assistant Examiner* — Steven A MacDonald
(74) *Attorney, Agent, or Firm* — Polsinelli PC

(57) ABSTRACT

Wire retrieval device to cut and recover wire or cable from a well. The wire retrieval device is suited for, among other applications, the retrieval of metallic, non-metallic, or composite wires from a wellbore. A method and system for retrieving a wire or cable from a well using a wire retrieval tool operable to cut a downhole wire and retain the cut segments in a holding cavity within the tool.

10 Claims, 13 Drawing Sheets

(56) References Cited

U.S. PATENT DOCUMENTS

2017/0350207 A1* 12/2017 Mineo ..... E21B 29/04

OTHER PUBLICATIONS

Hunting, Flopetrol—Rotary Wireline Cutters, Retreived on May 1, 2015 from http://www.hunting-intl.com/media/478308/rotary_cutters.pdf.

Clemens, J. et al., New Slickline Smart Release Tool Mitigates Wire Recovery Issues in Extreme Well Conditions (Abstract Only), Oct. 4, 2009, https://www.onepetro.org/conference-paper/SPE-124966-MS.

International Search Report and Written Opinion dated Jan. 4, 2016 in International Application No. PCT/US2015/039784.

* cited by examiner

DOWNHOLE WIRE RETRIEVAL DEVICE FOR METALLIC AND NON-METALLIC WIRE

CROSS-REFERENCE TO RELATED APPLICATIONS

This application is a national stage entry of PCT/US2015/039784 filed Jul. 9, 2015, said application is expressly incorporated herein in its entirety.

FIELD

The present disclosure relates to fishing tools used to recover equipment from subterranean wellbores. In particular, the present disclosure relates to tools used to recover wires and cables from a well.

BACKGROUND

Wellbores are drilled into the earth for a variety of purposes including tapping into hydrocarbon bearing formations to extract the hydrocarbons for use as fuel, lubricants, chemical production, and other purposes. In order to facilitate processes and operations in the wellbore, various tools may be conveyed downhole on a wire or cable. In some cases, the conveyed tool may become lodged in the wellbore causing the wire or cable to break when an attempt is made to pull the tool to the surface. As a result, wires or cables may be lost in the wellbore which can prevent or render difficult the further use of the wellbore for its intended purpose. It may often be necessary to retrieve wires and cables from a subterranean wellbore.

BRIEF DESCRIPTION OF THE DRAWINGS

In order to describe the manner in which the advantages and features of the disclosure can be obtained, reference is made to embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

It should be understood at the outset that although illustrative implementations of one or more embodiments are illustrated below, the disclosed apparatus, methods, and systems may be implemented using any number of techniques. The disclosure should in no way be limited to the illustrative implementations, drawings, and techniques illustrated herein, but may be modified within the scope of the appended claims along with their full scope of equivalents. Unless otherwise specified, any use of any form of the term "couple," or any other term describing an interaction between elements is not meant to limit the interaction to direct interaction between the elements and also may include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "upper," or "uphole" meaning toward the surface of the wellbore and with "lower," or "downhole" meaning toward the terminal end of the well, regardless of the wellbore orientation. The various characteristics described in more detail below, will be readily apparent to those skilled in the art with the aid of this disclosure upon reading the following detailed description, and by referring to the accompanying drawings.

The present disclosure generally relates to a device for retrieving wires or cables from within a wellbore. Wellbore operations often utilize downhole tools to facilitate production of hydrocarbons from a hydrocarbon formation. Downhole tools can be conveyed into the wellbore using various types of wires or cables. For example, a downhole tool can be conveyed on slickline, wireline, e-line, braided line, composite wire, metallic wire or non-metallic wire. In some instances, the downhole tool may become lodged within the wellbore causing the wire to break when an attempt is made to pull the tool in the uphole direction. In other cases, the wire, as opposed to the downhole tool, may become lodged in the wellbore due to either friction or drag of the wire on the wellbore wall or because the wellbore pressure is greater than the formation pressure, resulting in the wire becoming differentially stuck to the wellbore wall. The downhole retrieval device disclosed herein facilitates cutting and retrieval of the downhole wire from the wellbore in order to allow operations to proceed.

Figure 1:
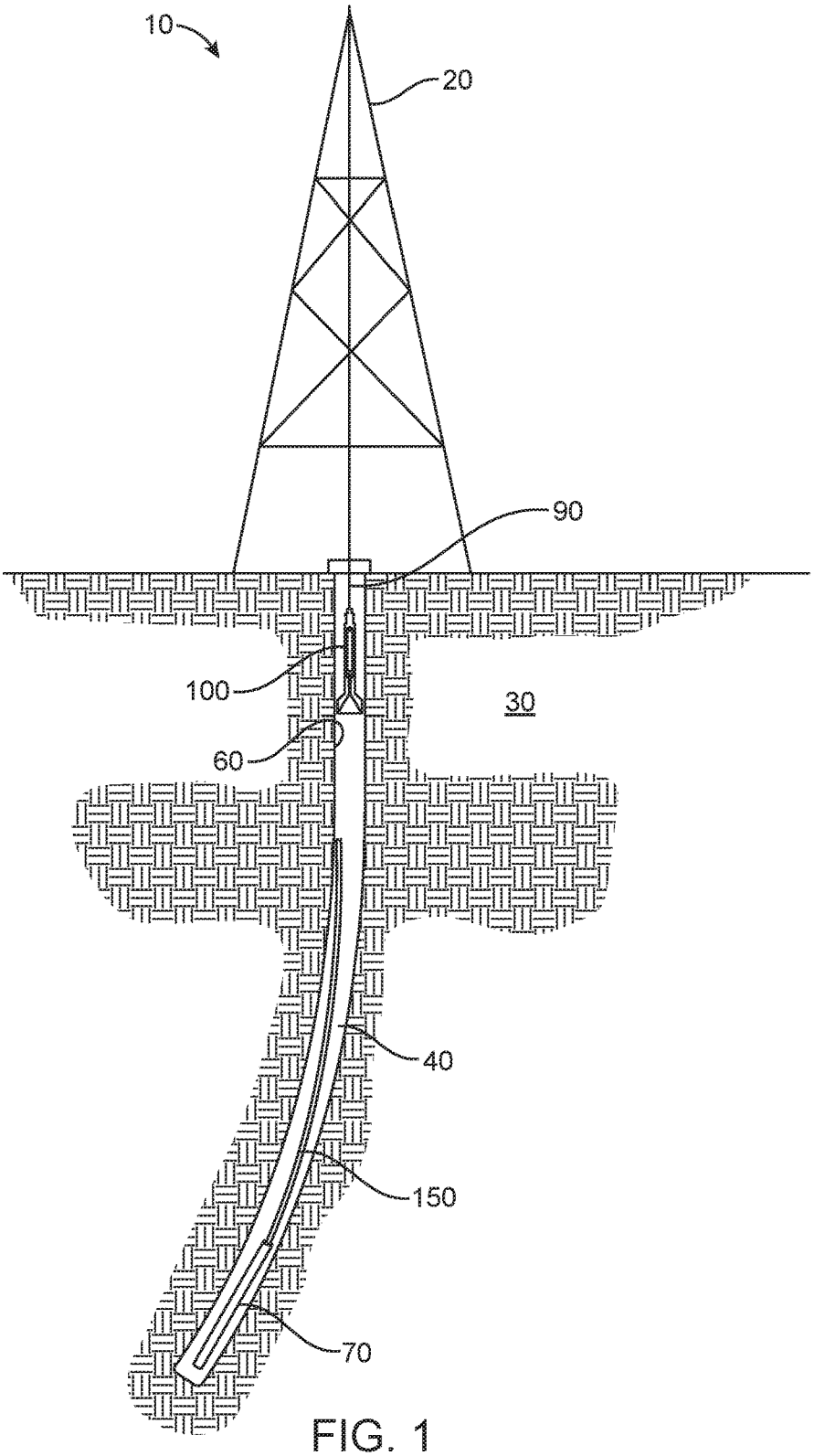
FIG. 1 is a schematic diagram of an embodiment of a wellbore operating environment in which a wire retrieval device may be deployed.

FIG. 1 illustrates a schematic view of an embodiment of a wellbore operating environment in which a wire retrieval device may be deployed. As depicted, the operating environment 10 includes a derrick 20 that extends over a wellbore 40 which has been drilled through a formation 30. The wellbore 40 contains a wire 150 that was severed or lost while conveying a downhole tool 70. The wire retrieval device 100 may be conveyed into the wellbore using a conveyance 90 in order to retrieve the wire 150. The conveyance 90 may include, but is not limited to, slickline, wireline, tubing, pipe, metallic wire, non-metallic wire, or composite wire.

The wellbore 40 includes a wellbore wall 60. The wellbore 40 can be an open hole, where only the formation 30 defines the wellbore wall 60, or the wellbore can be a cased hole, in which steel tubing or pipe defines the wellbore wall 60. In some cases, the wellbore wall 60 can refer to tubing or other conduits known in the art which may be used to convey equipment into the wellbore. Accordingly, the wire retrieval device 100 may be conveyed into the wellbore 40 after the wellbore 40 is drilled but before it is cased, or after the wellbore is cased. The wire retrieval device 100 may also be conveyed inside of tubing or other conduit in order to retrieve a downhole wire therein.

As illustrated, the wellbore 40 is a deviated wellbore or a wellbore that has been directionally drilled into formation 30. The wire retrieval device 100 is suitable for use in any wellbore without departing from the spirit and scope of the disclosure. Accordingly, the wire retrieval device 100 may be conveyed in vertical or horizontal wellbores, or may be conveyed in wellbores that are drilled to produce water, natural resources, or that are drilled in order to convey utilities.

The wire retrieval device 100 can be used to retrieve all types of wire 150 or cable used to convey downhole tools in a wellbore, including but not limited to slickline, wireline, e-line, braided line, composite wire, metallic wires and non-metallic wires. In some cases, the wire retrieval device, disclosed herein, can be used to retrieve non-metallic downhole wires or composite wires which due to their stiffness and low weight are especially prone to stand-up along the general longitudinal axis of the wellbore, as depicted in FIG. 1. Examples of a non-metallic wire can include a carbon composite rod with embedded electrical cables for communication with downhole tools, such as C6 Technologies ComTrac®, or a composite carbon rod, such as Ziebel's Z-System® or Z-Line®. Composite wires can be made of both metallic and non-metallic portions or components. In other cases, the wire retrieval device may be used to retrieve metallic downhole wires from a wellbore.

The wire retrieval device 100 can be lowered over a wire 150 in the wellbore, thereby causing the wire 150 to enter a holding cavity of the wire retrieval device. Thereafter, a cutting tool in the wire retrieval device 100 can be activated to cut the wire and retain the cut wire segment in the holding cavity of the device. The cut wire segment can be recovered from the wellbore by pulling the wire retrieval device 100 to the surface. Further, the holding cavity of the wire retrieval device can be sized to hold a plurality of cut wire segments allowing the wire retrieval device to be repeatedly lowered over the wire 150 so as to cut and retain a plurality of wire segments before the wire retrieval device 100 is pulled to the surface. Accordingly, the wire retrieval device 100 can be repeatedly lowered over the wire 150 until the wire 150 is substantially retrieved from the wellbore 40. FIGS. 2A-2D illustrate stepwise an exemplary cutting and retrieval of a wire using the wire retrieval device 100.

Figure 2A:
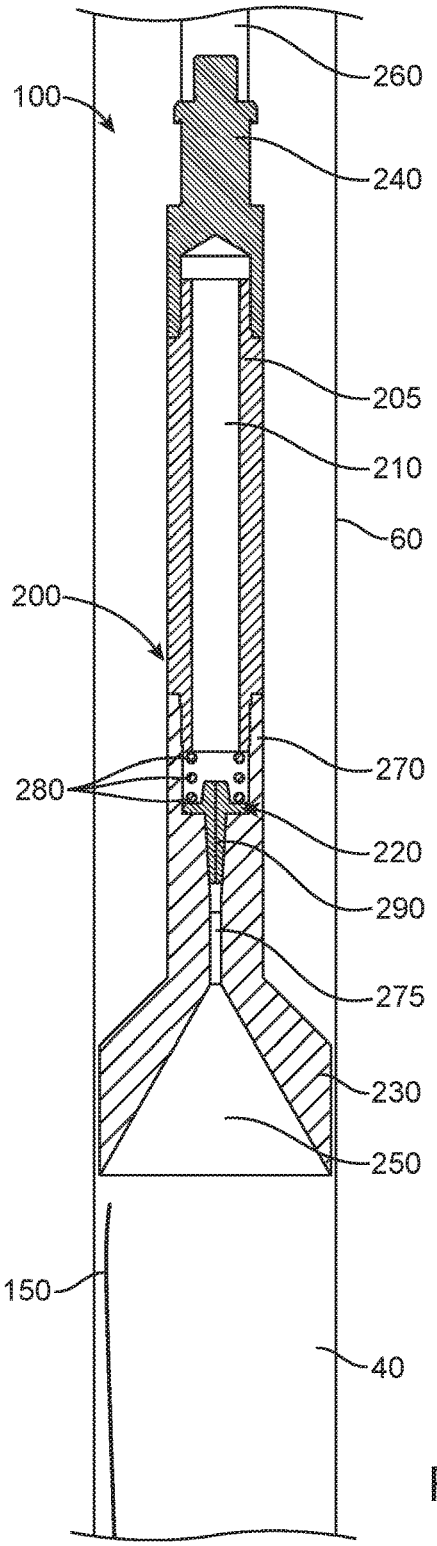
FIG. 2A is a sectional view of a wire retrieval device being lowered toward a wire in a wellbore, according to an exemplary embodiment.

FIG. 2A illustrates a sectional view of a wire retrieval device 100 being lowered in the wellbore 40 toward a wire 150. The wire retrieval device 100 includes an elongated housing 200 defining a holding cavity 210. The holding cavity 210 can be any length without departing from the spirit and scope of the disclosure. In some instances, the holding cavity 210 can be at least 20 feet in length. In other cases, the holding cavity 210 can be at least 30 feet in length. The size of the holding cavity 210 is not limited and can be adapted to the particular wellbore 40 or length(s) of wire 150 to be retrieved. The elongated housing 200 includes an upper housing end 205, located on the uphole end of the wire retrieval device 100, and a lower housing end 270, located on the downhole end of the wire retrieval device 100.

The upper housing end 205 can be coupled to a fishneck portion 240 which couples the wire retrieval device 100 to a conveyance. The fishneck portion 240 also provides a means for retrieving the wire retrieval device 100, by fishing tools known in the art, in the event that the wire retrieval device 100 is lost downhole. As depicted in FIG. 2A, the fishneck portion 240 is coupled to a spang jar 260 via a threaded joint. The spang jar 260 may be coupled with one or more stem bars or weights (not shown) or may be directly coupled to a conveyance. The wire retrieval device 100 can be conveyed into the wellbore 40 on a conventional toolstring or can be conveyed into the wellbore 40 by any conveyance known in the art, including, but not limited to slickline, wireline, tubing, pipe, composite wire, metallic wire, and non-metallic wire.

The upper housing end 205 is coupled to the lower housing end 270 of the wire retrieval device 100. The lower housing end 270 includes an opening 275 in the downhole direction that allows communication between the wellbore 40 and the holding cavity 210. A cutting tool 220 is positioned at least in part in the lower housing end 270 opening 275. As depicted in FIG. 2A, the cutting tool 220 includes a plurality of wedge-shaped members 290 slidably disposed in the lower housing end 270. When assembled together, the plurality of wedge-shaped members 290 form a cone-shaped cutting tool 220 with a sharp cutting edge on the upper portion of the cutting tool 220. In some cases the cutting tool 220 can be comprised of two to four wedge-shaped members. However, the cutting tool 220 can be comprised of fewer or more numerous wedge-shaped members without departing from the spirit and scope of this disclosure.

As shown in FIG. 2A, the cutting tool 220 is in the closed position prior to contacting the downhole wire 150. As depicted, the cutting tool 220 can be maintained in the closed position by springs 280. The springs 280 bias or urge the cutting tool 220 against the lower housing end 270 prior to contact with wire 150. The springs 280 can be characterized by any bias or strength so long as the springs 280 are adapted to maintain the cutting tool 220 in a closed position until contact with the wire 150, as well as allow the cutting tool 220 to longitudinally shift toward the upper housing end 205 once contacted by the wire 150. In some instances, the springs 280 can be coiled springs. However, means other than springs for maintaining the cutting tool 220 in a closed position may be used without departing from the spirit and scope of the present disclosure.

As shown in FIG. 2A, the lower housing end 270 includes a guide 230 which defines a receiving space 250 having an interior surface shaped so as to direct the wire 150 into the receiving space 250 and toward the opening 275 in the lower housing end 270. The guide 230 can be sized to the inner diameter of the wellbore wall 60 so that any gap between the wellbore wall 60 and the guide 230 is less than the thickness of the wire 150 being retrieved. The guide 230 can be cone-shaped or cylindrical in order to isolate the wire 150 from any portion of the wellbore wall 60 as the wire retrieval device 100 is being lowered into the wellbore 40. In some cases, the wire retrieval device 100 can be configured such that guides 230 of different sizes may be interchangeably installed on the device 100 in order to adapt the wire retrieval device 100 to the particular dimensions of a wellbore 40 having a wire 150 therein.

Figure 2B:
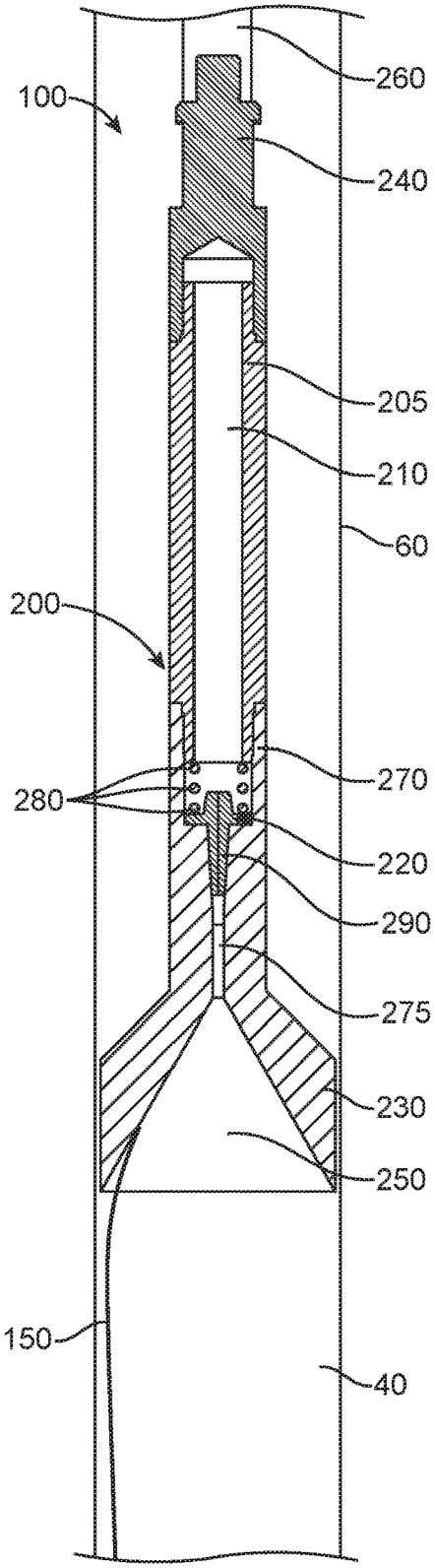
FIG. 2B is a sectional view of a wire retrieval device after a downhole wire has entered the receiving space of a wire retrieval device, according to an exemplary embodiment.

FIG. 2B illustrates a sectional view of a wire retrieval device 100 after being lowered into a wellbore 40 such that the downhole wire 150 has entered the receiving space 250 of the guide 230 of the device 100. As shown in FIG. 2B, the guide 230 has isolated the wire 150 from the wellbore wall 60 and has directed it toward the opening 275 in the lower housing end 270.

Figure 2C:
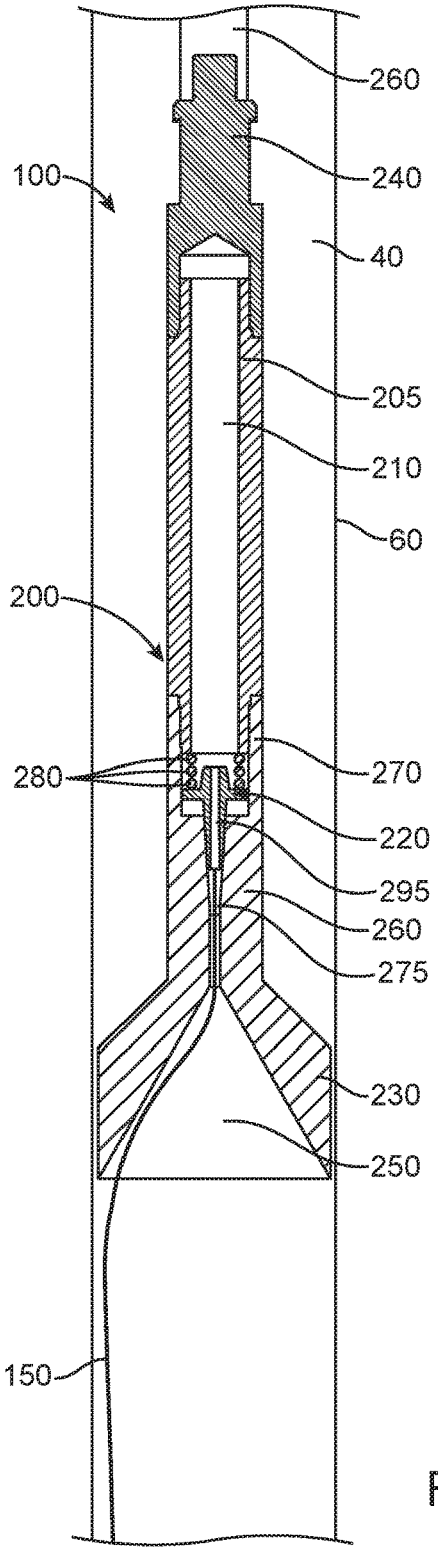
FIG. 2C is a sectional view of a wire retrieval device after a wire has contacted the cutting tool of a wire retrieval device, according to an exemplary embodiment.

FIG. 2C illustrates a sectional view of a wire retrieval device 100 after being lowered into a wellbore 40 such that the downhole wire 150 has contacted the cutting tool 220 of the device 100. As depicted in FIG. 2C, the wire 150 has been guided by the guide 230 into the opening 275 of the lower housing end 270 and into contact with the cutting tool 220. As the wire 150 contacts the cutting tool 220, the weight of the toolstring and the device 100, as well as the stiffness of the wire 150, causes the cutting tool 220 to compress the relatively weak springs 280 and longitudinally shift toward the upper housing end 205. As the cutting tool 220 longitudinally shifts toward the upper housing end 205, the cutting tool transitions to the open position, producing a passageway 295 for the wire 150 to pass through the cutting tool 220 and into the holding cavity 210.

Figure 2D:
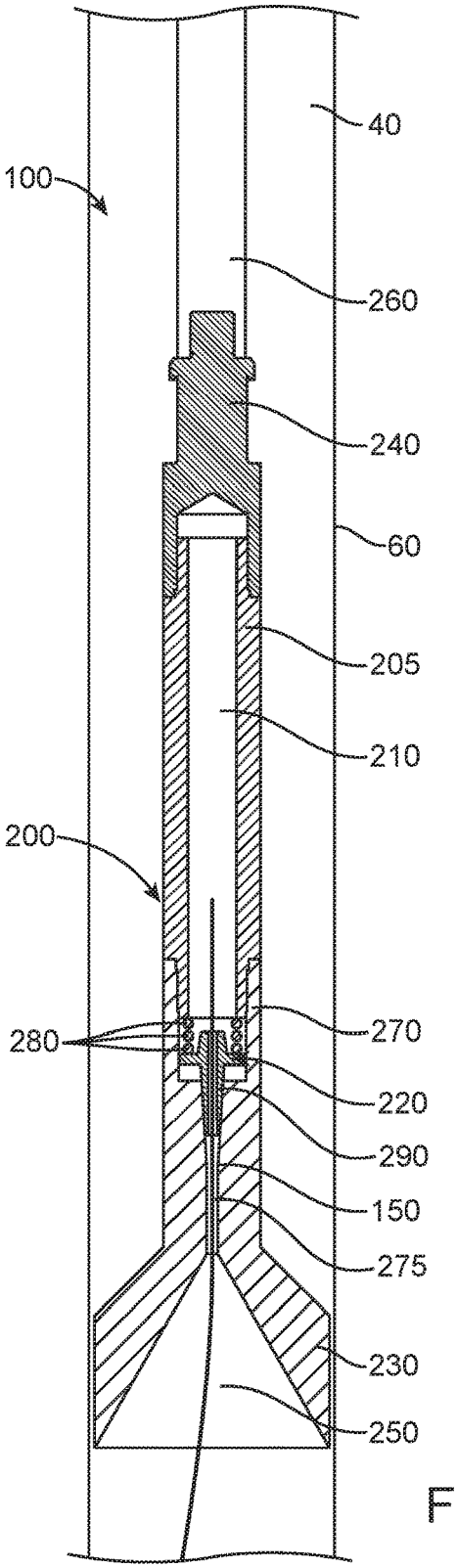
FIG. 2D is a sectional view of a wire retrieval device after a wire has entered into a holding cavity of a wire retrieval device, according to an exemplary embodiment.

FIG. 2D illustrates a sectional view of a wire retrieval device 100 after being lowered into the wellbore 40 such that the wire 150 has entered through the cutting device 220 and into the holding cavity 210. As shown in FIG. 2D, the cutting device 220 is in the open position, allowing the wire 150 to pass through the cutting device 220 and into the holding cavity 210.

Figure 3A:
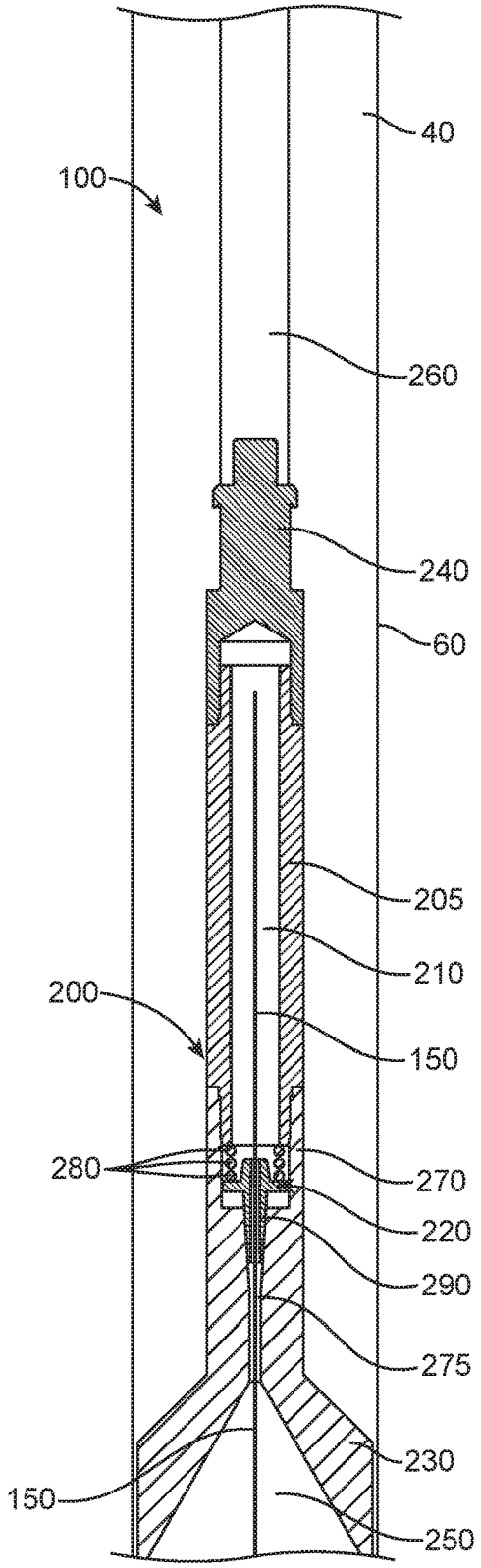
FIG. 3A is a sectional view of a wire retrieval device after a wire has entered the holding cavity of a wire retrieval device, according to an exemplary embodiment.

FIG. 3A illustrates a sectional view of a wire retrieval device 100 after being lowered into a wellbore 40 such that a downhole wire 150 has entered the holding cavity 210 of the device. The cutting device 220 can be activated to cut the wire 150 while retaining the cut wire segment in the holding cavity 210 of the wire retrieval device. The cutting device 220 can be activated to cut the wire 150 by pulling the wire retrieval device 100 in an uphole direction. Alternatively, the cutting device 220 can be activated by mechanical or hydraulic force or in response to a control signal sent from the surface without departing from the spirit and scope of the present disclosure.

Figure 3B:
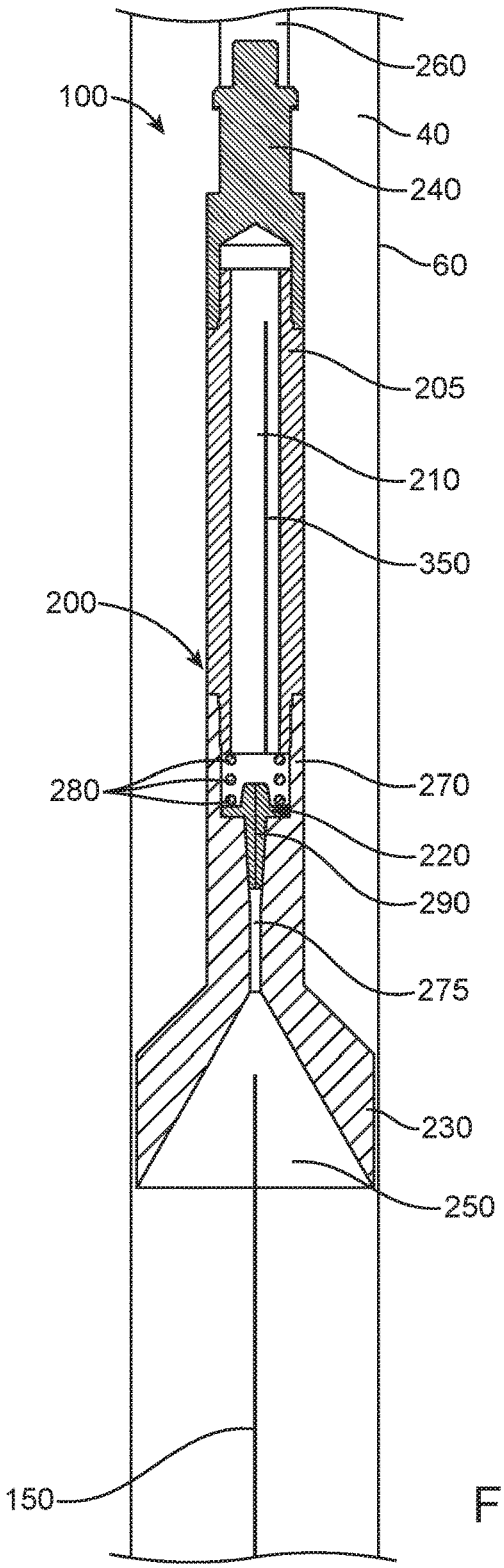
FIG. 3B is a sectional view of a wire retrieval device after a wire segment has been cut and retained in the holding cavity, according to an exemplary embodiment.

FIG. 3B illustrates a sectional view of a wire retrieval device 100 after the cutting tool 220 has been activated to cut the wire 150 by pulling the wire retrieval device 100 in the uphole direction. The cutting tool 220 includes a plurality of wedge-shaped members 290 that are configured to prevent the wire 150 from moving back out of the holding cavity 210 once the wire has entered the holding cavity 210. Accordingly, when the wire retrieval device 100 is pulled uphole the tension on the wire 150 increases. When the tension in the wire 150 exceeds an established tension or peak load, the cutting tool 220 longitudinally shifts toward the lower housing end 270 causing the passageway between the wedge-shaped members 290 to radially collapse, thereby activating the cutting tool 220 to cut the wire 150. As depicted in FIG. 3B, the cut wire segment 350 is retained in the holding cavity 210 of the wire retrieval device 100. After the cutting tool 220 is activated to cut the wire 150, the cutting tool 220 remains in the closed position until contacted by a new portion of the wire 150.

Figure 4:
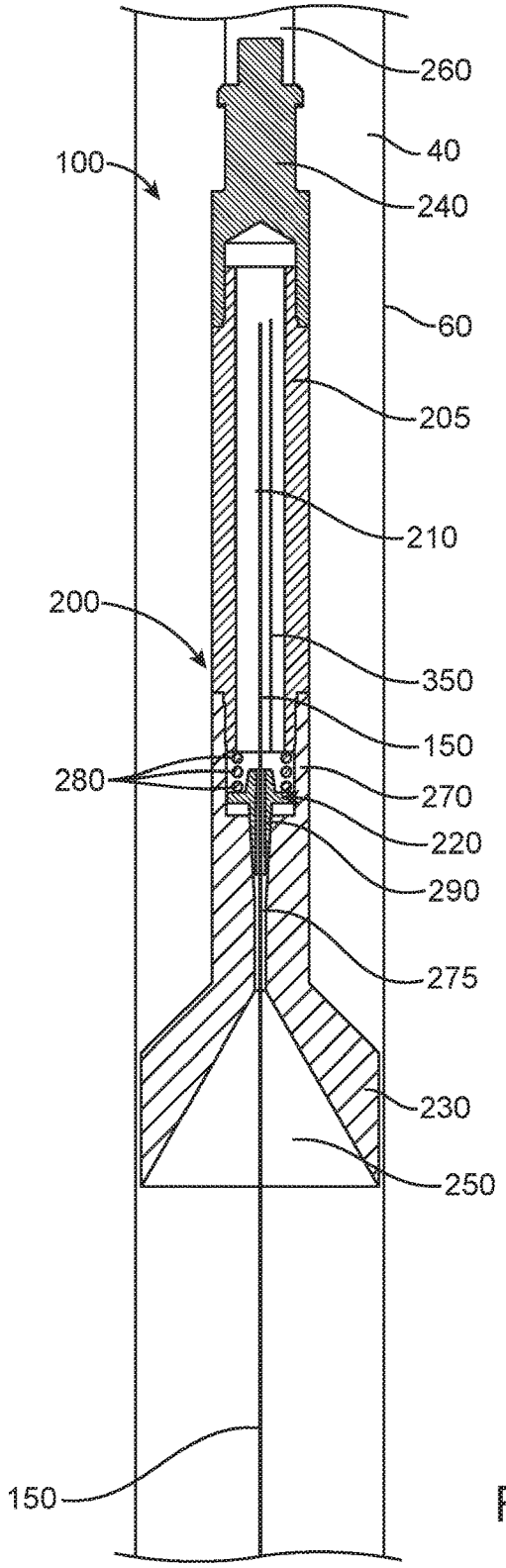
FIG. 4 is a sectional view of a wire retrieval device that has been lowered over a wire after previously cutting and retaining a segment of wire, according to an exemplary embodiment.

FIG. 4 is a sectional view of a wire retrieval device 100 that has been lowered over a wire 150 in the wellbore after previously cutting and retaining a segment of wire 350 in the holding cavity 210 of the device 100. The cutting tool 220 is shown in the open position, resulting from a new portion of wire 150 having entered through the opening 275 in the lower housing end 270 and pushed through the cutting tool 220 into the holding cavity 210. As depicted in FIG. 4, the holding cavity 210 is sized to retain and store a plurality of cut wire segments 350 so that repeated lowering of the device 100 over a wire 150, followed by activating the cutting tool 220 to cut the wire 150, can be used to generate a plurality of retained cut wire segments 350 before the wire retrieval device 100 is pulled to the surface thereby recovering the cut wire from the wellbore. In some cases, the wire retrieval device 100 can be used to repeatedly cut and retain segments of a downhole wire 150 until the wire 150 is substantially removed from the wellbore 40.

Figure 5:
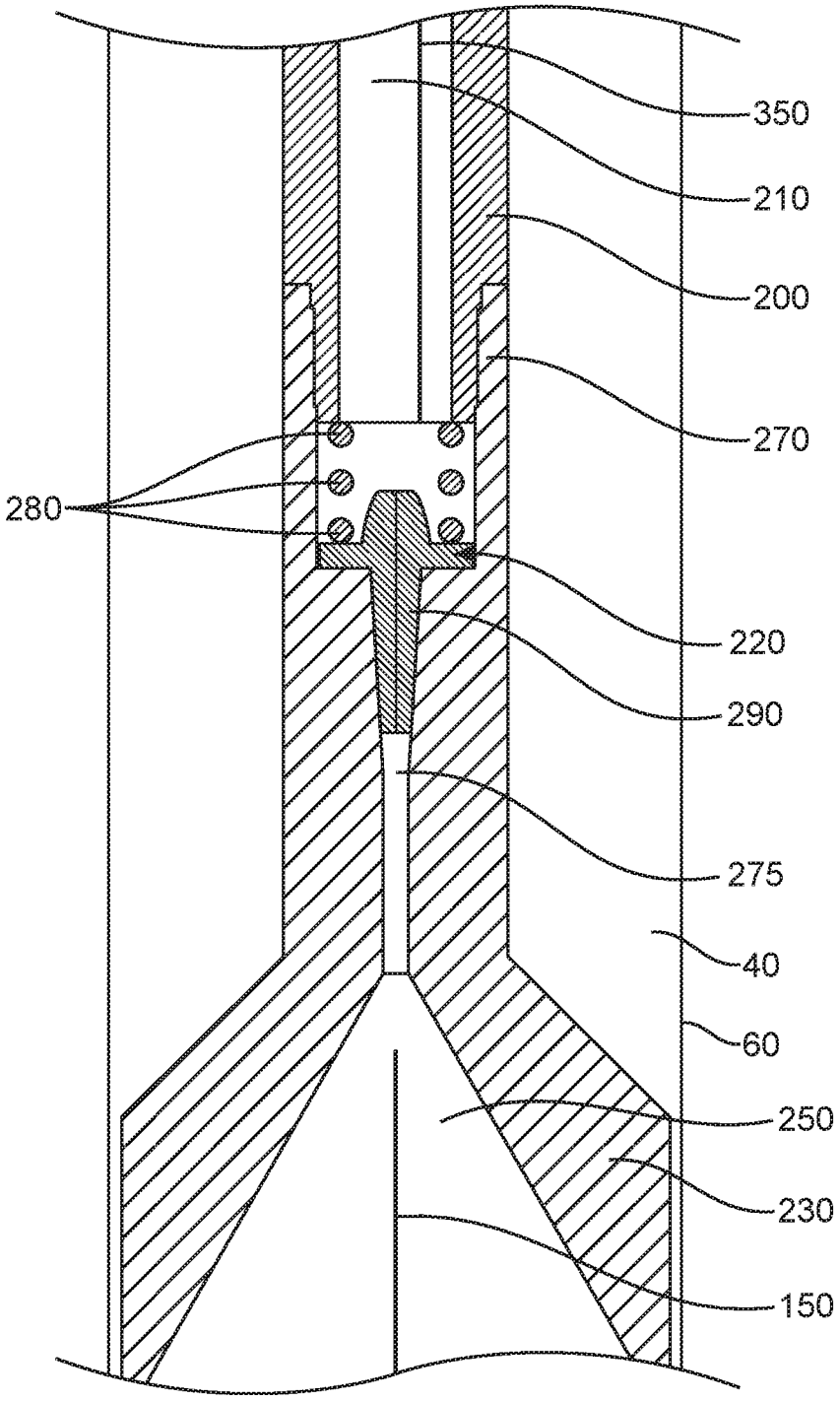
FIG. 5 is a close-up sectional view of a cutting tool portion of a wire retrieval device shown in the closed position prior to being contacted by a wire in the wellbore, according to an exemplary embodiment.

FIG. 5 illustrates a close-up sectional view of the cutting tool 220 portion of the wire retrieval device 100. As shown in FIG. 5, the cutting tool 220 is in the closed position after having cut wire segment 350. The previously cut wire segment 350 is retained in the holding cavity 210. Prior to being contacted by wire 150, the cutting tool 220 is maintained in the closed position by springs 280.

Figure 6:
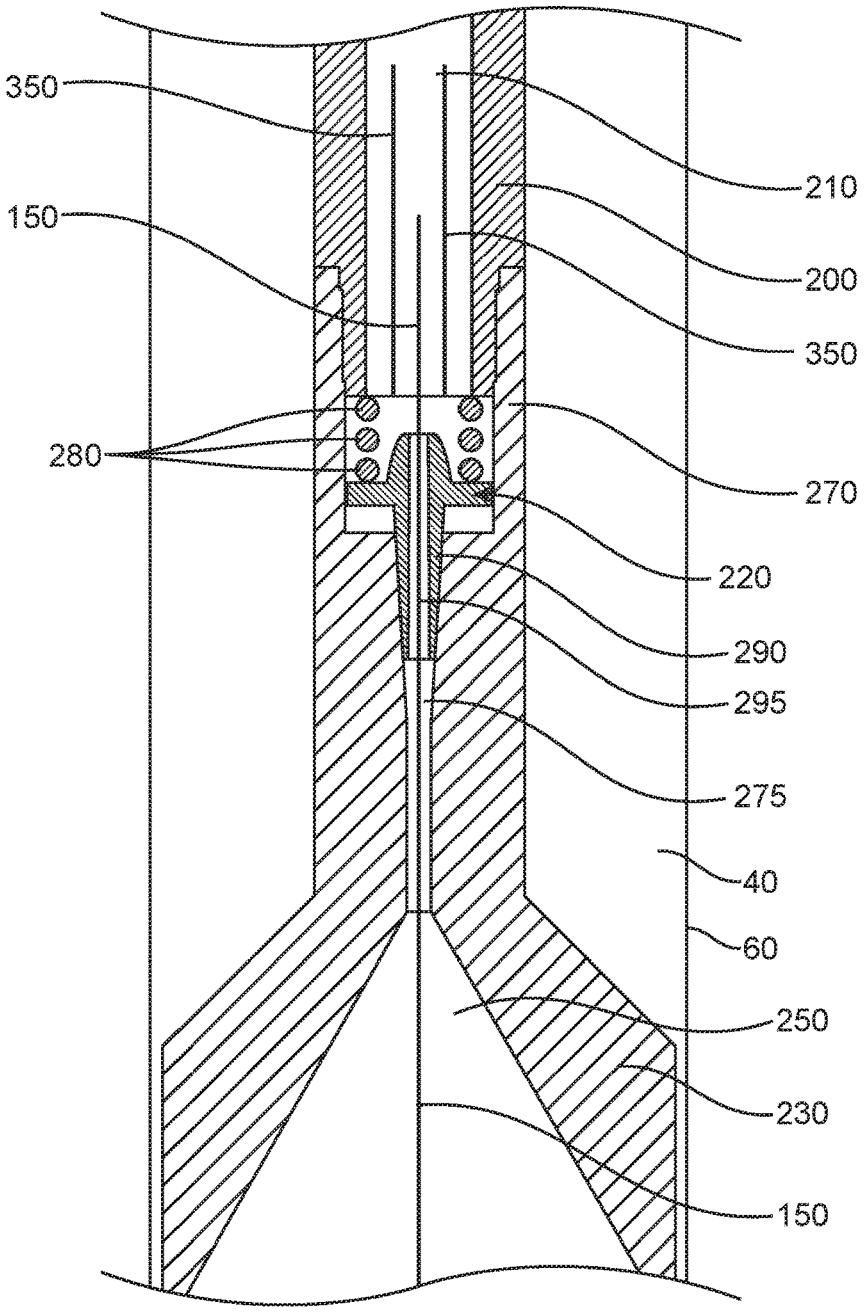
FIG. 6 is a close-up sectional view of a cutting tool portion of a wire retrieval device shown in the open position after a wire has passed through the cutting tool, according to an exemplary embodiment.

FIG. 6 illustrates a close-up sectional view of the cutting tool 220 portion of the wire retrieval device 100 after the device 100 has previously cut and retained a plurality of wire segments 350 in the holding cavity 210. As shown in FIG. 6, the cutting tool 220 has transitioned into the open position by contact with the downhole wire 150. The cutting tool 220 includes a plurality of wedge-shaped members 290 slidably disposed in the lower housing end 270. When assembled together, the plurality of wedge-shaped members 290 can form a cone-shaped cutting tool 220 with a sharp cutting edge on the upper portion of the cutting tool 220.

Upon contacting the cutting tool 220, the wire 150 frictionally causes the wedge-shaped members 290 of the cutting tool 220 to shift longitudinally toward the upper housing end 205, thereby compressing the springs 280. As the cutting tool 220 shifts longitudinally toward the upper housing end 205, the wedge-shaped members 290 that comprise the cutting tool 220 radially expand outward opening a passageway 295 between the elements of the cutting tool 220 and allow the wire 150 to pass through the cutting tool 220 and enter the holding cavity 210. In some cases, the weight of the toolstring and the wire retrieval device 100, as well as the stiffness of the wire 150, contribute to the wire 150 causing the cutting tool 220 to shift longitudinally toward the upper housing end 205.

The plurality of wedge-shaped members 290 that comprise the cutting tool 220 further prevent the wire 150 from moving back out of the holding cavity 210 once the wire has entered the holding cavity 210. As tension in the wire 150 begins to cause the wire 150 to move back out of the holding cavity 210, the wire 150 causes the wedge-shaped elements including the cutting tool 220 to shift longitudinally toward the lower housing end 270 which causes the passageway 295 between the wedge-shaped members 290 to radially collapse onto the wire 150, thereby preventing further wire 150 movement. In some cases, the wedge-shaped members 290 can further include a gripping surface to grip or increase friction with the wire 150, thereby further preventing the wire 150 from moving back out of the holding cavity 210.

Figure 7:
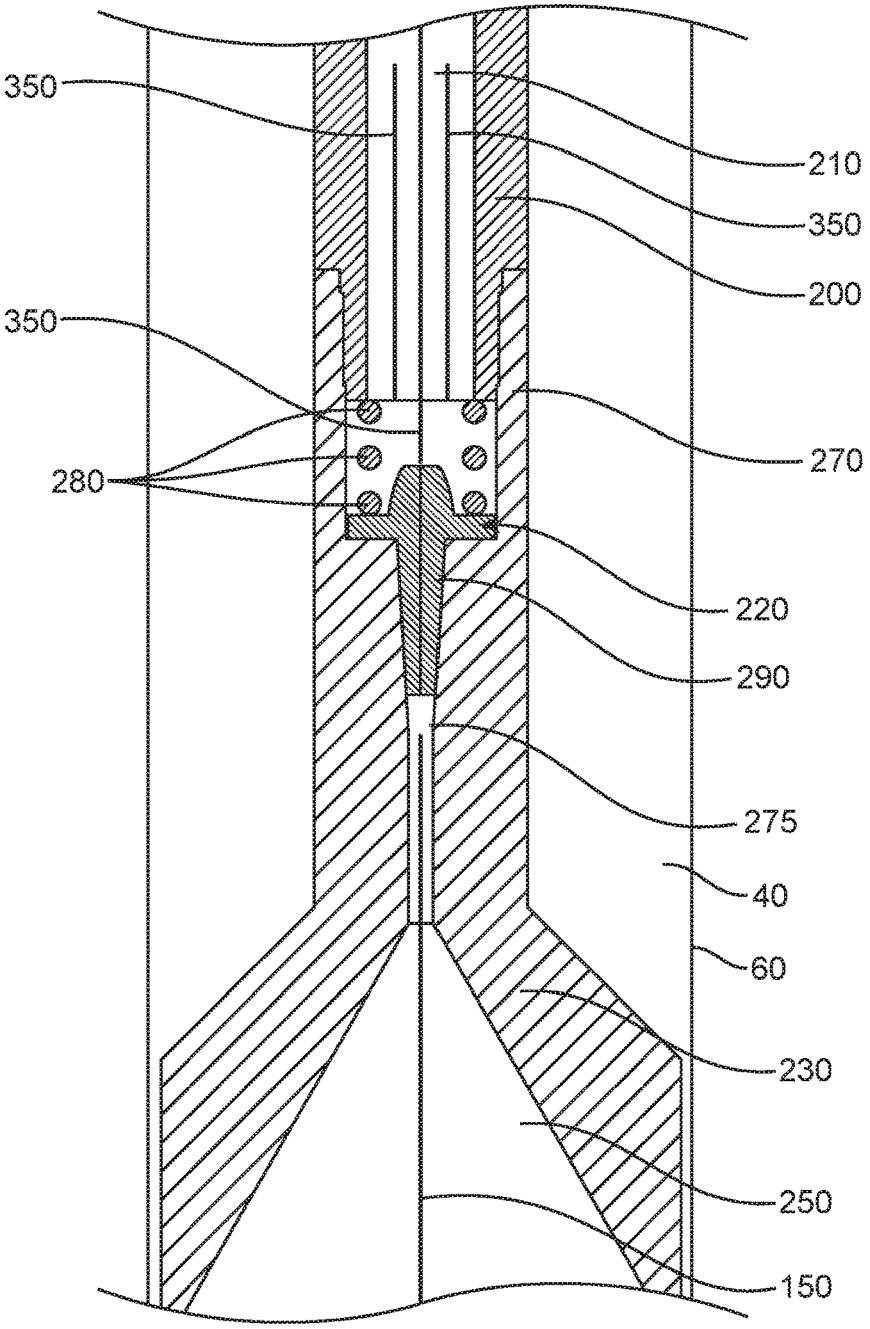
FIG. 7 is a close-up sectional view of the cutting tool portion of a wire retrieval device in the closed position after having cut a wire segment, according to an exemplary embodiment.

FIG. 7 illustrates a close-up sectional view of the cutting tool 220 portion of the wire retrieval device 100. As shown in FIG. 7, the cutting tool 220 is shown in the closed position after having been activated to cut the wire 150 to form the wire segment 350. The cutting tool 220 can be activated to cut the wire 150 by pulling the wire retrieval device 100 in the uphole direction. Because the cutting tool 220 includes a plurality of wedge-shaped members 290 configured to resist movement of the wire 150 out of the holding cavity 210, pulling the device 100 in the uphole direction causes tension in the wire 150 to increase until it exceeds an established tension or peak load, thereby actuating the cutting tool 220 to shift longitudinally toward the lower housing end 270. The longitudinal shifting of the cutting tool 220 causes the internal diameter of the passageway between the wedge-shaped members 290 to become smaller until the cutting tool 220 is activated to cut the wire 150. After cutting the wire 150 to produce retained wire segment 350, the cutting tool 220 remains in the closed position until contacted by a new portion of the wire 150. Alternatively, the cutting device 220 can be activated by mechanical or hydraulic force or in response to a control signal sent from the surface without departing from the spirit and scope of the present disclosure.

As shown in FIG. 7, the cut wire segment 350 is retained in the holding cavity 210 of the wire retrieval device 100. Additionally, holding cavity 210 has retained a plurality of previously cut wire segments 350.

Figure 8A:
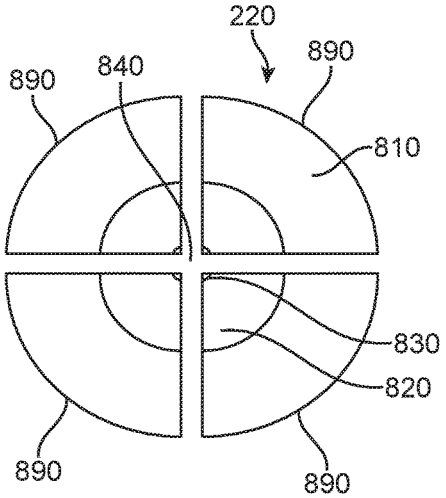
FIG. 8A is a top-down view of the cutting tool portion of a wire retrieval device in the open position, according to an exemplary embodiment.

FIG. 8A is a top-down view of the cutting tool 220 portion of the wire retrieval device in the open position. As shown in FIG. 8A, the cutting tool 220 includes four wedge-shaped members 890. However, the cutting tool 220 may include a fewer or greater number of wedge-shaped members 890 without departing from the spirit and scope of the present disclosure. Each wedge-shaped member 890 includes an outer portion 810 that is coupled to a spring 280 (not shown) and is configured to contact an upper portion of the lower housing end 270 when the cutting tool 220 is in the closed position. Each wedge-shaped member 890 further includes an inner portion 820 coupled to a cutting edge 830 configured to cut a downhole wire 150. As shown in FIG. 8A, when the cutting tool 220 is in the open position, the wedge-shaped members 890 are radially extended so as to form a passageway 840 allowing a wire to pass through the cutting tool 220 and into the holding cavity.

Figure 8B:
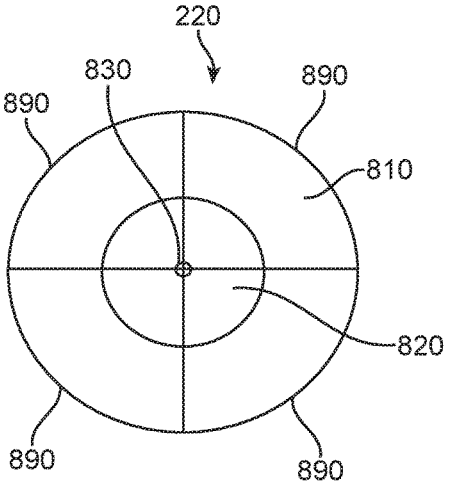
FIG. 8B is a top-down view of the cutting tool portion of a wire retrieval device in the closed position, according to an exemplary embodiment.

FIG. 8B is a top-down view of the cutting tool 220 portion of the wire retrieval device in the closed position. As shown in FIG. 8B, the wedge-shaped members 890 are radially collapsed so as to close the passageway and cause the cutting edge 830 to cut the wire. The cutting tool 220 is configured to transition to the open position when a wire contacts the bottom of the wedge-shaped members 890 causing the upper surface of the outer portion 810 of the wedge-shaped members 890 to compress the spring (not shown), thereby allowing the wedge-shaped members 890 to expand radially and open a passageway for the wire to enter the holding cavity.

As disclosed herein, a method of retrieving a wire from a well is provided. The method includes providing a wire retrieval tool that includes an elongated housing defining a holding cavity and having a lower housing end and an upper housing end opposite the first end. The lower housing end of the wire retrieval tool further includes an opening allowing communication between the wellbore and the holding cavity. The wire retrieval tool further includes a cutting tool positioned at least in part in the lower housing end opening. The method further includes lowering the wire retrieval tool into a well having a wire therein so as to cause the lower housing end to pass over the wire and allow an end of the wire to enter into the holding cavity. The method further includes activating the cutting tool to cut the wire. The method also includes retaining the cut wire segment in the holding cavity of the wire retrieval tool.

In some cases, the method of retrieving a wire from a well can further include repeating one or more times: passing the lower end of the housing over the wire to allow an and of the wire to pass into the holding cavity of the device, activating the cutting tool to cut the wire, and retaining the cut wire segment in the holding cavity, so as to produce a plurality of cut wire segments in the holding cavity of the wire retrieval tool.

The method can also include a wire retrieval tool that includes a guide coupled to the lower housing end and extending in the downhole direction. The guide includes an interior surface shaped to direct the wire into the lower housing end and into the holding cavity. In some cases, the guide can be sized to an inner diameter of a wall of the wellbore so that any gap between the wellbore wall and the guide is less than the thickness of the wire being retrieved. In some cases, the method can include selecting and installing the appropriate diameter guide on the wire retrieval tool for the particular dimensions of the wellbore or tubing containing the downhole wire.

Figure 9:
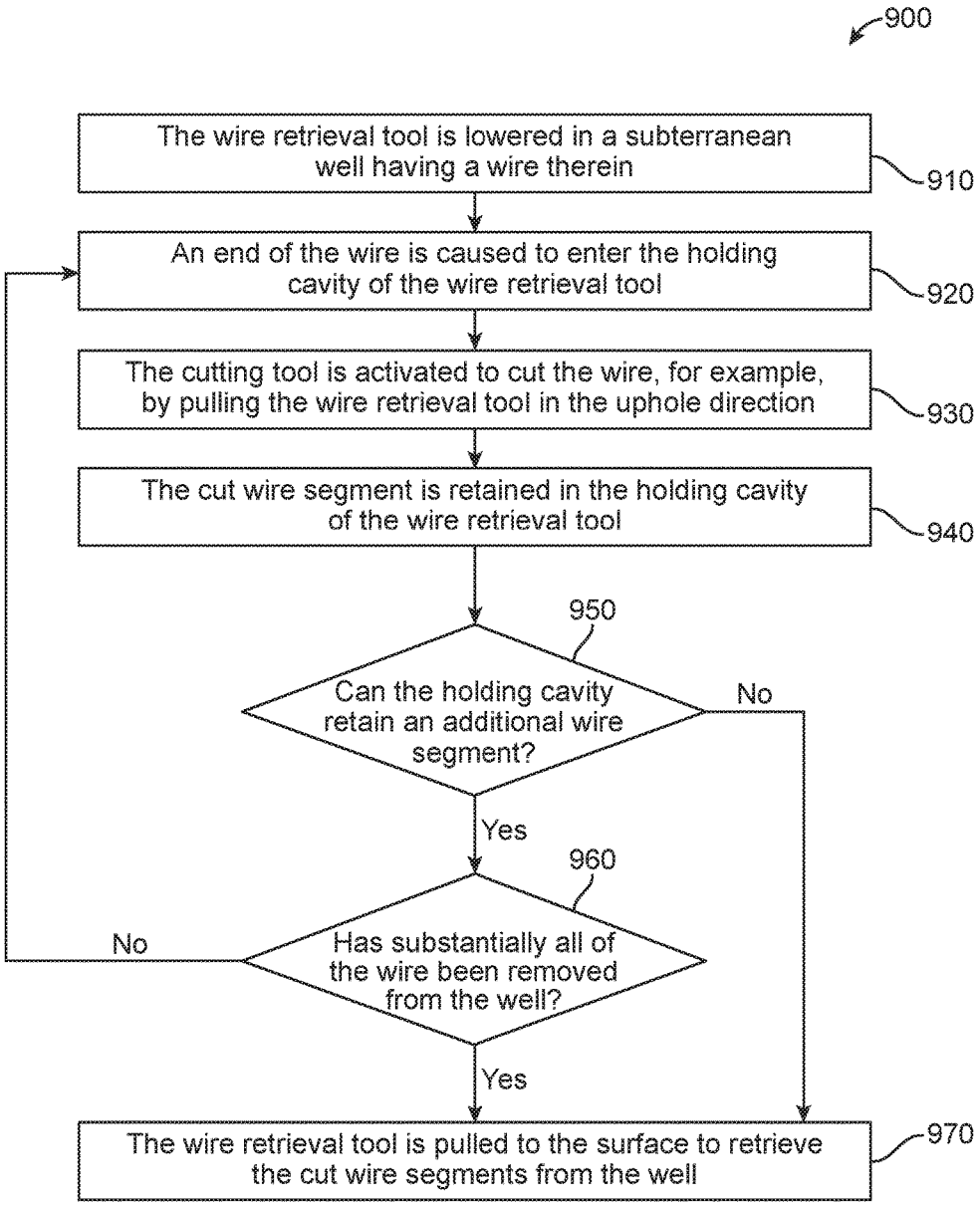
FIG. 9 is a flowchart describing a method of retrieving a wire from a well, according to an exemplary embodiment.

Referring to FIG. 9, a flowchart is presented in accordance with an exemplary embodiment. The exemplary method shown in FIG. 9 is provided by way of an example, as there are a variety of ways to carry out the method. Each block shown in FIG. 9 represents one or more processes or methods carried out in the example method shown in FIG. 9. Furthermore, the illustrated order of blocks is illustrative only and the order of the blocks can change according to the present disclosure. Additional blocks can be added or fewer blocks can be utilized, without departing from this disclosure.

The method 900 can begin at block 910. At block 910, a wire retrieval tool is lowered in a subterranean well that contains a lost wire. At block 920, an end of the wire is caused to enter the holding cavity of a wire retrieval tool. The cutting tool is activated to cut the wire at block 930. The cutting tool can be activated to cut the wire, for example, by pulling the wire retrieval tool in the uphole direction. Alternatively, the cutting tool can be activated by mechanical or hydraulic force or in response to a control signal sent from the surface. At block 940, the cut wire segment is retained in the holding cavity of the wire retrieval tool. At block 950, a determination is made regarding whether the holding cavity of the wire retrieval tool is capable of retaining an additional wire segment. If the holding cavity cannot retain an additional wire segment, the wire retrieval tool is pulled to the surface to retrieve the cut wire segments from the well at block 970. If the holding cavity can retain an additional wire segment, then a determination is made at block 960 regarding whether substantially all of the wire has been removed from the well. If substantially all of the wire has been removed from the well then the wire retrieval tool is pulled to the surface to retrieve the cut wire segments from the well at block 970. If it is determined at block 960 that not substantially all of the wire has been removed from the well, the blocks beginning with block 920 are repeated. Additionally, the entire method 900 may be repeated as necessary to substantially retrieve the wire from the well.

The method can also include a tool that includes a cutting tool comprised of a wedge-shaped member configured to prevent wire that has entered the holding cavity of the tool from moving back out of the holding cavity. In some cases, the cutting tool used in the method can be made up of a plurality of wedge-shaped members slidably disposed in the lower housing end of the tool. In some cases, the plurality of wedge-shaped members can further include a gripping surface configured to prevent wire that has entered the holding cavity of the tool from moving back out of the holding cavity. In some instances, the plurality of wedge-shaped members can form a cone-shaped cutting tool with a sharp cutting edge on the upper portion of the cutting tool, when assembled together. In some cases, the cutting tool used in the method can further include a spring configured to maintain the plurality of wedge-shaped members in a closed cutting position prior to contacting a downhole wire. In some instances, the cutting tool used in the method can include a spring that is further configured to allow a wire to cause the plurality of wedge-shaped members to shift longitudinally toward the upper housing end, thereby transitioning to an open position and providing a passageway for the wire to pass through and enter the holding cavity of the tool.

In some cases, the method of retrieving a wire from a well can further include activating the cutting tool to cut the wire by pulling the wire retrieval tool in the uphole direction. In some instances, the method can include activating the cutting tool to cut the wire when the tension in the wire exceeds an established tension or peak load. In some cases, the method can include activating the cutting tool to cut the wire by causing tension in the wire sufficient to cause the wedge-shaped members to longitudinally shift toward the lower housing end, thereby collapsing the internal diameter of the passageway until a sharp edge on the wedge-shaped members cuts the wire.

In some cases, the method can include a wire retrieval tool including a holding cavity that is at least one foot in length. In some cases, the method can include a wire retrieval tool including a holding cavity that is at least 20 feet in length. In other cases, the method can include a wire retrieval tool including a holding cavity that is at least 30 feet in length. In some cases, the method can be used to retrieve a non-metallic wire or a composite wire from a well. In other cases, the method can be used to retrieve a metallic wire from a well.

As disclosed herein, a system for retrieving a wire from a well is provided. The system includes a wire contained within a wellbore and a wire retrieval tool inserted in the wellbore. The wire retrieval tool, included in the system, includes an elongated housing defining a holding cavity and having a lower housing end and an upper housing end opposite the lower housing end. The lower housing end of the wire retrieval tool further includes an opening allowing communication between the wellbore and the holding cavity. The wire retrieval tool further includes a cutting tool positioned at least in part in the lower housing end opening. The tool also includes a guide extending from the lower housing end and defining a receiving space having an interior surface shaped to direct the wire into the receiving space through the cutting tool and into the defined holding cavity, upon lowering the device into the wellbore. The wire retrieval tool used in the system further includes a cutting tool that is repeatedly activatable to cut the wire after a portion of the wire has moved through the cutting tool into the holding cavity. The wire retrieval tool used in the system further includes a holding cavity that is sized to hold a plurality of cut wire segments.

The system can also include a wire retrieval tool that includes a guide sized to an inner diameter of a wall of the wellbore so any gap between the wellbore wall and the guide is less than the thickness of the wire being retrieved. In some cases, the system can include a guide that was selected to have an appropriate diameter for the particular dimensions of the wellbore containing the downhole wire.

The system can also include a wire retrieval tool that includes a cutting tool comprised of a wedge-shaped member configured to prevent wire that has entered the holding cavity of the tool from moving back out of the holding cavity. In some cases, the cutting tool used in the system can be comprised of a plurality of wedge-shaped members slidably disposed in the lower housing end of the wire retrieval tool. In some instances, the plurality of wedge-shaped members can further include a gripping surface configured to prevent wire that has entered the holding cavity of the wire retrieval tool from moving back out of the holding cavity. In some cases, the plurality of wedge-shaped members can form a cone-shaped cutting tool with a sharp cutting edge on the upper portion of the cutting tool, when assembled together. In some instances, the cutting tool used in the system can further include a spring configured to maintain the plurality of wedge-shaped members in a closed cutting position, prior to contacting a downhole wire. In some cases, the cutting tool used in the system can include a spring that is further configured to allow a wire to cause the plurality of wedge-shaped members to shift longitudinally toward the upper housing end, thereby transitioning to an open position and providing a passageway for the wire to pass through and enter the holding cavity of the tool.

In some cases, the system for retrieving a wire from a well can further include a cutting tool repeatedly activatable to cut the wire by pulling the tool in the uphole direction. In some instances, the system can include activating the cutting tool to cut the wire when the tension in the wire exceeds an established tension or peak load. In some cases, the system can include activating the cutting tool to cut the wire by causing tension in the wire sufficient to cause the wedge-shaped members to longitudinally shift toward the lower housing end, thereby collapsing the internal diameter of the passageway until a sharp edge on the wedge-shaped members cuts the wire.

In some cases, the system can include a wire retrieval tool including a holding cavity that is at least one foot in length. In some cases, the system can include a wire retrieval tool including a holding cavity that is at least 20 feet in length. In other cases, the system can include a wire retrieval tool including a holding cavity that is at least 30 feet in length. In some instances, the system can be used to retrieve a non-metallic wire or a composite wire from a well. In other cases, the system can be used to retrieve a metallic wire from a well.

Statements of the Disclosure Include:

Statement 1: A wire retrieval device comprising: an elongated housing defining a holding cavity and having an upper housing end and a lower housing end opposite the upper housing end, the lower housing end including an opening communicating with the defined holding cavity, a cutting tool positioned at least in part in the lower housing end opening, a guide extending from the lower housing end and defining a receiving space having an interior surface shaped to direct a wire into the receiving space through the cutting tool and into the defined holding cavity upon lowering the device into the wellbore, wherein the cutting tool is activatable to cut the wire after a portion of the wire has moved through the cutting tool into the holding cavity.

Statement 2: A wire retrieval device according to Statement 1, wherein the cutting tool is repeatedly activatable to cut the wire and wherein the holding cavity is sized to hold a plurality of cut wire segments.

Statement 3: A wire retrieval device according to Statement 1 or Statement 2, wherein the cutting tool is configured to be activated to cut the wire by pulling the wire retrieval device in the uphole direction.

Statement 4: A wire retrieval device according to any one of the preceding Statements 1-3, wherein the device is usable to retrieve a non-metallic wire.

Statement 5: A wire retrieval device according to any one of the preceding Statements 1-3, wherein the device is usable to retrieve a composite wire.

Statement 6: A wire retrieval device according to any one of the preceding statements 1-3, wherein the device is usable to retrieve a carbon composite wire.

Statement 7: A wire retrieval device according to any one of the preceding Statements 1-6, wherein the cutting tool comprises a wedge-shaped member configured to prevent wire having entered the holding cavity from moving back out of the holding cavity.

Statement 8: A wire retrieval device according to any one of the preceding Statements 1-7, wherein the cutting tool comprises a spring.

Statement 9: A wire retrieval device according to any one of the preceding Statements 1-8, wherein the elongated housing comprises a length of at least 20 feet.

Statement 10: A wire retrieval device according to any one of the preceding Statement 1-9, wherein the elongated housing comprises a length of at least 30 feet.

Statement 11: A wire retrieval device according to any one of the preceding Statements 1-10, wherein the guide is sized to an inner diameter of a wall of the wellbore so any gap between the wellbore wall and the guide is less than the thickness of the wire being retrieved.

Statement 12: A method of retrieving a wire from a well, the method comprising: (a) providing a wire retrieval device according to any one of the preceding Statements 1-11, (b) lowering the tool into a well having a wire therein, (c) passing the lower housing end over the wire to allow an end of the wire to pass into the holding cavity, (d) activating the cutting tool to cut the wire, and (e) retaining the cut wire segment in the holding cavity.

Statement 13: A method of retrieving a wire from a well according to Statement 12, further comprising repeating (c), (d), and (e) one or more times to produce a plurality of cut wire segments in the holding cavity.

Statement 14: A method of retrieving a wire from a well according to Statements 12 or 13, wherein the wire is a non-metallic wire.

Statement 15: A method of retrieving a wire from a well according to Statements 12 or 13, wherein the wire is a composite wire.

Statement 16: A method of retrieving a wire from a well according to Statements 12 or 13, wherein the wire is a carbon composite wire.

Statement 17: A method of retrieving a wire from a well according to any one of the preceding Statements 12-16, wherein the cutting tool is activated to cut the wire by pulling the tool in the uphole direction.

Statement 18: A method of retrieving a wire from a well according to any one of the preceding Statements 12-17, further comprising pulling the wire retrieval device to the surface to retrieve the cut wire segments from the well.

Statement 19: A method of retrieving a wire from a well according to any one of the preceding Statements 12-18, further comprising determining whether the holding cavity of the wire retrieval device can retain an additional wire segment.

Statement 20: A method of retrieving a wire from a well according to any one of the preceding Statements 12-19, further comprising determining whether substantially all of the wire has been removed from the well.

Statement 21: A method of retrieving a wire from a well, the method comprising: (a) providing a wire retrieval tool comprising: an elongated housing defining a holding cavity and having a lower housing end and an upper housing end opposite the first end, the lower housing end including an opening communicating with the defined holding cavity, a cutting tool positioned at least in part in the lower housing end opening, (b) lowering the wire retrieval tool into a well having a wire therein (c) passing the lower housing end over the wire to allow an end of the wire to pass into the holding cavity (d) activating the cutting tool to cut the wire, and (e) retaining the cut wire segment in the holding cavity.

Statement 22: A method of retrieving a wire from a well according to Statement 21, further comprising repeating (c), (d), and (e) one or more times to produce a plurality of cut wire segments in the holding cavity.

Statement 23: A method of retrieving a wire from a well according to Statements 21 or 22, wherein the wire is a non-metallic wire.

Statement 24: A method of retrieving a wire from a well according to Statements 21 or 22, wherein the wire is a composite wire.

Statement 25: A method of retrieving a wire from a well according to Statements 21 or 22, wherein the wire is a carbon composite wire.

Statement 26: A method of retrieving a wire from a well according to any one of the preceding Statements 21-25, wherein the cutting tool is activated to cut the wire by pulling the wire retrieval tool in the uphole direction.

Statement 27: A method of retrieving a wire from a well according to any of the preceding Statements 21-26, wherein the cutting tool comprises a wedge-shaped member configured to prevent wire having entered the holding cavity from moving back out of the holding cavity.

Statement 28: A method of retrieving a wire from a well according to any of the preceding Statements 21-27, wherein the wire retrieval tool further comprises a guide coupled to the lower housing end and extending in the downhole direction, wherein the guide has an interior surface shaped to direct the wire into the lower housing end opening and into the holding cavity.

Statement 29: A method of retrieving a wire from a well according to Statement 28, wherein the guide is sized to an inner diameter of a wall of the wellbore so any gap between the wellbore wall and the guide is less than the thickness of the wire being retrieved.

Statement 30: A method of retrieving a wire from a well according to any of the preceding Statements 21-29, wherein the cutting tool comprises a spring.

Statement 31: A method of retrieving a wire from a well according to any of the preceding Statements 21-30, wherein the holding cavity comprises a length of at least 20 feet.

Statement 32: A method of retrieving a wire from a well according to any of the preceding Statements 21-31, wherein the holding cavity comprises a length of at least 30 feet.

Statement 33: A method of retrieving a wire from a well according to any of the preceding Statements 21-32, further comprising pulling the wire retrieval tool to the surface to retrieve the cut wire segments from the well.

Statement 34: A method of retrieving a wire from a well according to any of the preceding Statements 21-33, further comprising determining whether the holding cavity of the wire retrieval tool can retain an additional wire segment.

Statement 35: A method of retrieving a wire from a well according to any of the preceding Statements 21-34, further comprising determining whether substantially all of the wire has been removed from the well.

Statement 36: A system for retrieving a wire from a well, the system comprising: a wellbore having a wire therein, and a wire retrieval device according to any one of the preceding Statements 1-11.

Statement 37: A system for retrieving a wire from a well according to Statement 36, wherein the wire is a non-metallic wire.

Statement 38: A system for retrieving a wire from a well according to Statement 36, wherein the wire is a composite wire.

Statement 39: A system for retrieving a wire from a well according to Statement 36, wherein the wire is a carbon composite wire.

Statement 40: A system for retrieving a wire from a well, the system comprising: a wire contained with a wellbore, and a wire retrieval tool inserted within the wellbore comprising: an elongated housing defining a holding cavity and having a lower housing end and an upper housing end opposite the lower housing end, the lower housing end including an opening communicating with the defined holding cavity, a cutting tool positioned at least in part in the lower housing end opening, a guide extending from the lower housing end and defining a receiving space having an interior surface shaped to direct the wire into the receiving space through the cutting tool into the defined holding cavity upon lowering the device into the wellbore, wherein the cutting tool is repeatedly activatable to cut the wire after a portion of the wire has moved through the cutting tool into the holding cavity, wherein the holding cavity is sized to hold a plurality of cut wire segments.

Statement 41: A system for retrieving a wire from a well according to Statement 40, wherein the wire is a non-metallic wire.

Statement 42: A system for retrieving a wire from a well according to Statement 40, wherein the wire is a composite wire.

Statement 43: A system for retrieving a wire from a well according to Statement 40, wherein the wire is a carbon composite wire.

Statement 44: A system for retrieving a wire from a well according to any of the preceding Statements 40-43, wherein the cutting tool is configured to be activated by pulling the wire retrieval tool in the uphole direction.

Statement 45: A system for retrieving a wire from a well according to any of the preceding Statements 40-44, wherein the cutting tool comprises a wedge-shaped member configured to prevent wire having entered the holding cavity from moving back out of the holding cavity.

Statement 46: A system for retrieving a wire from a well according to any of the preceding Statements 40-45, wherein the outer diameter of the guide is sized to the inner diameter of a wall of the wellbore so any gap between the wellbore wall and the guide is less than the thickness of the wire being retrieved.

Statement 47: A system for retrieving a wire from a well according to any of the preceding Statements 40-46, wherein the cutting tool is repeatedly activatable to cut the wire and wherein the holding cavity is sized to hold a plurality of cut wire segments.

Statement 48: A system for retrieving a wire from a well according to any of the preceding Statements 40-47, wherein the cutting tool comprises a spring.

Statement 49: A system for retrieving a wire from a well according to any of the preceding Statements 40-48, wherein the elongated housing comprises a length of at least 20 feet.

Statement 50: A system for retrieving a wire from a well according to any of the preceding Statements 40-49, wherein the elongated housing comprises a length of at least 30 feet.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims. Moreover, claim language reciting "at least one of" a set indicates that a system including either one member of the set, or multiple members of the set, or all members of the set, satisfies the claim.

We claim:

1. A wire retrieval device comprising:

an elongated housing defining a holding cavity and having an upper housing end and a lower housing end opposite the upper housing end, the lower housing end including an opening communicating with the defined holding cavity;

a cutting tool positioned at least in part in the lower housing end opening;

a guide extending from the lower housing end and defining a receiving space having an interior surface shaped to direct a wire into the receiving space through the cutting tool and into the defined holding cavity upon lowering the device into a wellbore, wherein the cutting tool is activatable to cut the wire after a portion of the wire has moved through the cutting tool into the holding cavity, and wherein the cutting tool is configured to be activated to cut the wire by pulling the wire retrieval device in the uphole direction.

2. The wire retrieval device according to claim 1, wherein the cutting tool is repeatedly activatable to cut the wire and wherein the holding cavity is sized to hold a plurality of cut wire segments.

3. The wire retrieval device according to claim 1, wherein the device is usable to retrieve a non-metallic wire.

4. The wire retrieval device according to claim 1, wherein the cutting tool comprises a wedge-shaped member configured to prevent wire having entered the holding cavity from moving back out of the holding cavity.

5. The wire retrieval device according to claim 4, wherein the cutting tool comprises a spring.

6. The wire retrieval device according to claim 1, wherein the holding cavity comprises a length of at least 20 feet.

7. The wire retrieval device according to claim 1, wherein the guide is sized to an inner diameter of a wall of the wellbore so any gap between the wellbore wall and the guide is less than the thickness of the wire being retrieved.

8. A system for retrieving a wire from a well, the system comprising:

a wire contained with a wellbore; and a wire retrieval tool inserted within the wellbore comprising:

an elongated housing defining a holding cavity and having a lower housing end and an upper housing end opposite the lower housing end, the lower housing end including an opening communicating with the defined holding cavity;

a cutting tool positioned at least in part in the lower housing end opening;

a guide extending from the lower housing end and defining a receiving space having an interior surface shaped to direct the wire into the receiving space through the cutting tool into the defined holding cavity upon lowering the device into the wellbore, wherein the cutting tool is repeatedly activatable to cut the wire after a portion of the wire has moved through the cutting tool into the holding cavity, wherein the holding cavity is sized to hold a plurality of cut wire segments.

9. The system according to claim 8, wherein the wire is a non-metallic wire.

10. The system according to claim 8, wherein the cutting tool is configured to be activated by pulling the wire retrieval tool in the uphole direction, wherein the cutting tool comprises a wedge-shaped member configured to prevent wire having entered the holding cavity from moving back out of the holding cavity, and wherein the outer diameter of the guide is sized to the inner diameter of a wall of the wellbore so any gap between the wellbore wall and the guide is less than the thickness of the wire being retrieved.

* * * * *